United States Patent [19]

Watzka

[11] 4,217,745

[45] Aug. 19, 1980

[54] TWIN PACKAGING MACHINE

[75] Inventor: Roland Watzka, Feuerthalen, Switzerland

[73] Assignee: SIG Schweizerische Industrie-Gesellschaft, Neuhausen am Rheinfall, Switzerland

[21] Appl. No.: 968,678

[22] Filed: Dec. 12, 1978

[30] Foreign Application Priority Data

Dec. 29, 1977 [CH] Switzerland ..... 16208/77

[51] Int. Cl.[3] ..... B65B 11/22; B65B 35/54; B65B 41/14

[52] U.S. Cl. ..... 53/531; 53/202; 53/228; 53/389

[58] Field of Search ..... 53/202, 228, 230, 542, 53/543, 389, 531; 271/225

[56] References Cited

U.S. PATENT DOCUMENTS

| | | | |
|---|---|---|---|
| 1,352,629 | 9/1920 | Remington | 53/202 |
| 1,831,245 | 11/1931 | Hitchcock | 271/225 |
| 1,927,011 | 9/1933 | Boileau | 53/202 X |
| 3,006,119 | 10/1961 | Fingerhut | 53/230 X |
| 3,322,131 | 5/1967 | Warfel | 53/542 |
| 3,429,098 | 2/1969 | Treiber | 53/389 |
| 3,778,963 | 12/1973 | Straujups | 53/389 X |

FOREIGN PATENT DOCUMENTS

| | | | |
|---|---|---|---|
| 565402 | 11/1932 | Fed. Rep. of Germany | 53/542 |

*Primary Examiner*—John Sipos
*Attorney, Agent, or Firm*—Spencer & Kaye

[57] ABSTRACT

In a twin packaging machine composed of two packaging units each including a folding device, an inlet path for feeding objects to be packaged to the device, a member storing a sheet of packaging material, a device for cutting successive packaging foils from the sheet, and an outlet path for the finished packages, the longitudinal axes of the inlet and outlet paths lying at least approximately in a common vertical plane, the sheets of packaging material are arranged in juxtaposition between the outlet paths of the units and are disposed to enter into the devices from the side opposite that at which the objects to be packaged enter the devices, the machine is provided with a support, and the inlet and outlet paths and the sheets of packaging material of the two units are symmetrically arranged relative to the longitudinal axis of the support.

5 Claims, 5 Drawing Figures

TWIN PACKAGING MACHINE

BACKGROUND OF THE INVENTION

The present invention relates to a twin packaging machine of the type provided with two folding devices, each having associated with it an input path for the objects to be packaged, a sheet of packaging material and an outlet path for the finished packages. Seen in a plan view, such outlet path lies at least approximately in the extension of the inlet path and successive packaging foils are cut from the sheet of packaging material.

In a known machine of this type, the inlet and outlet paths are arranged on the same side of a housing in the manner of a balcony. This has the drawback that the path portions further removed from the housing vibrate extensively during operation, unless this is prevented by provision of a particularly robust and costly structure. Moreover, the sheets are usually introduced into the folding devices in a direction oblique to the inlet and outlet paths and such introduction of the sheets of packaging material is difficult. If the folding devices contain folding wheels, the machine must be made particularly wide and accessibility thereto becomes particularly difficult.

SUMMARY OF THE INVENTION

It is an object of the present invention to eliminate, or at least substantially reduce, the above drawbacks while providing a machine which can easily be monitored to assure its proper operation.

These and other objects are accomplished according to the present invention, by a machine in which the sheets of packaging material are arranged in juxtaposition with the outlet paths and enter the folding devices from the side opposite that of the objects to be packaged; and in which the two folding devices and their associated paths are arranged symmetrically with respect to a longitudinal support.

These measures result in a very simple, economical and easily supervisable arrangement of the most important machine parts.

DESCRIPTION OF THE PREFERRED EMBODIMENTS

Figure 3:
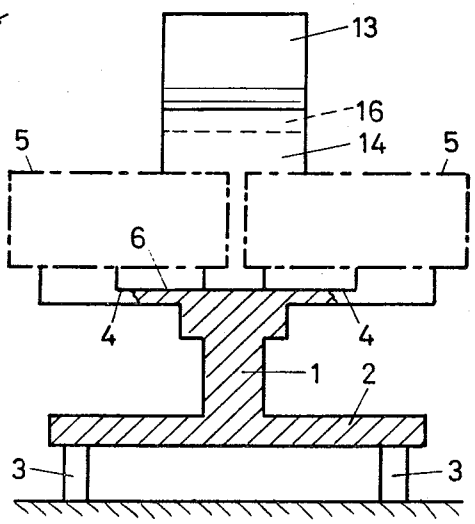
FIG. 3 is a cross-sectional view along the line III—III of FIG. 1.

The illustrated twin packaging machine, which serves, for example, for packaging candy covered chewing gum, includes a longitudinal support, or carrier, 1 which broadens at the bottom into a base plate 2 supported on four feet 3. The carrier 1 is provided with two symmetrical arms 4 which support two folding devices 5 disposed above a centrally located upper recess 6 in carrier 1. For reasons of simplicity, carrier 1 is shown by hatching in FIG. 3, as being solid throughout; in practice, however, it is designed, at least in part, to serve as the housing for non-illustrated parts of the machine.

Figure 1:
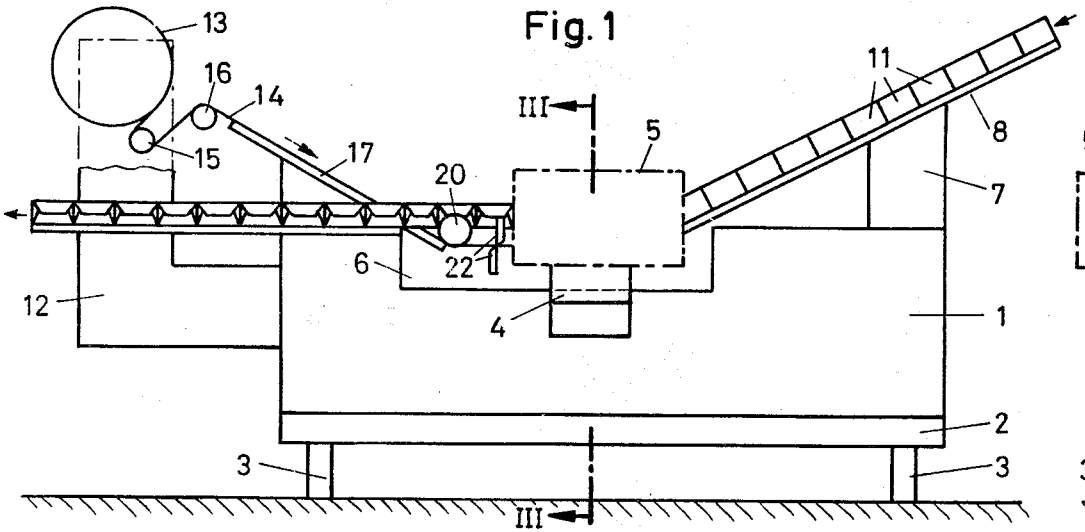
FIG. 1 is a side elevational view of a preferred embodiment of a packaging machine according to the invention.

At the front end of carrier 1, there are provided two supports 7 for two inclined inlet paths 8 which are arranged symmetrically with respect to the longitudinal axis of carrier 1 and which open at their bottom ends into respective ones of the folding devices 5. The paths 8 are subdivided by means of partitions 9 into a plurality of parallel channels 10 in which objects 11 to be packaged e.g. candies, slide downwardly. These objects, which each have an approximately rectangular profile, travel on edge and one row of these objects is shown in FIG. 1, with the channel walls removed.

Figure 2:
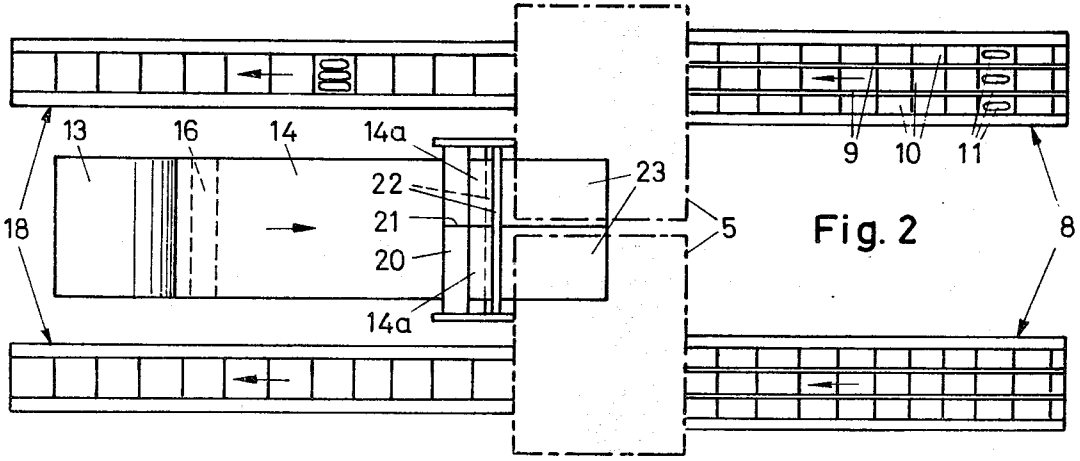
FIG. 2 is a plan view of the machine of FIG. 1.

At the rear end of carrier 1, there are provided two angled supports 12 for a supply roll 13 from which a sheet of wrapping paper 14 is removed by conventional means, e.g. a pair of rolls and rollers 15 and 16, onto a suitable delivery path 17. Parts 12 and 17 are not shown in FIGS. 2 and 3. The supply roll 13 and the sheet of paper 14 lie between two horizontal outlet paths 18 which emanate from the two folding devices 5 and whose geometric longitudinal axes, when seen in a plan view, lie in, or at least approximately in, respective extensions of the geometric axes of the inlet paths 8. Each folding device 5 forms each successive group of objects arriving thereat into a package 19, shown in FIGS. 4 and 5.

The sheet of paper 14 moves, when seen in the plan view, in the direction opposite to that of the packages 19 along outlet path 18. At the lower end of the inclined path 17, a roller 20 having a circular central cutter 21 is provided to cut the sheet of paper 14 in half in the longitudinal direction so that two panels **14*a* of packaging material are produced, each associated with a respective folding device 5. Two transverse blades 22 are provided behind roller 20 to cut rectangular foils 23 from the two panels 14*a*, each foil producing a package 19**.

Figure 4:
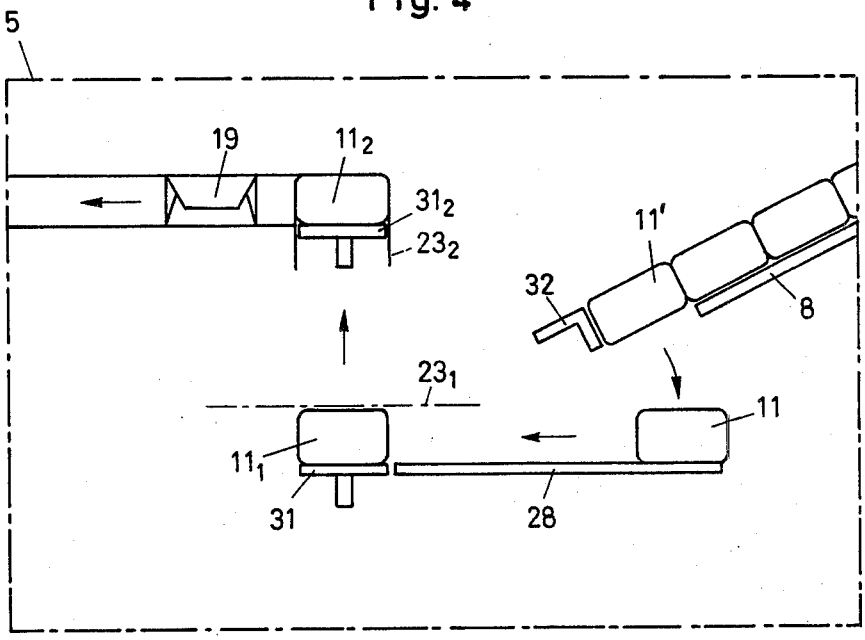
FIG. 4 is a side elevational view of the essential components of a folding device included in the machine of FIGS. 1–3.
Figure 5:
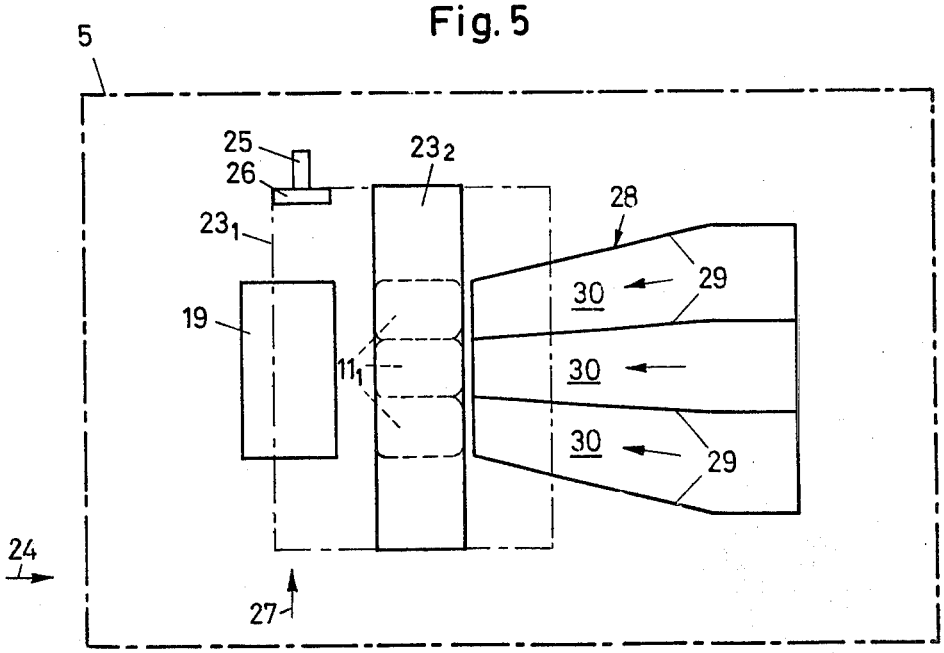
FIG. 5 is a plan view of the structure shown in FIG. 4.

When, as shown in FIG. 5, one packaging foil 23 has entered the folding device 5 in the direction of the arrow 24, it is pulled in a direction perpendicular thereto by means of jaws 26 of a gripper 25 in the direction of the arrow 27 until it reaches the position $\mathbf{23}_1$ shown in dot-dash lines. As shown in FIG. 4, the objects 11 at the lower end of the inlet path 8 move successively onto a table 28 which forms three channels 30 defined by partitions 29, shown in FIG. 5, the channels tapering in the direction toward a vertically movable folding plunger 31. In FIG. 4, the partitions 29 are not shown.

A fixed abutment 32 causes the foremost object 11' in each channel of path 8 to always be in the same position before being lowered onto the table 28. From there, advancing means (not shown) of a known type push the objects onto the folding plunger 31 when the latter is in its lowermost position. A pivot arm, which is not shown, may be used for the lowering movement. Preferably, a known separator device is provided at the lower end of the inlet path 8 so as to remove objects 11 that are too short.

It can be seen that the objects $\mathbf{11}_1$ on plunger 31 lie closely adjacent one another underneath foil $\mathbf{23}_1$ due to the convergence of the channels 30, the foil having been centered on the plunger 31 by being moved thereon in the direction of arrows 24 and 27 by suitable grippers. Now plunger 31 is pushed into position $\mathbf{31}_2$ so that it carries along the objects $\mathbf{11}_1$ and the foil $\mathbf{23}_1$ toward the top. During this phase, folding abutments (not shown) fold the foil tightly around objects $11_2$, as shown at $23_2$. Further known folding means which become effective upon retraction of plunger $31_2$ then close the foil on its broadside and at the frontal faces of the resulting package 19, and the package 19 then moves in the direction of the arrow 33 toward the associated outlet path 18.

All of the mechanisms shown in FIGS. 4 and 5 are constructed according to principles and techniques already well known in the art, so that these mechanisms are not shown or described in detail.

Instead of a single supply roll 13, which is cut in half lengthwise by the rotating cutter 21, two supply rolls may be arranged in juxtaposition for supplying two panels of paper which already have the correct width for feeding the folding devices 5. Of course, instead of paper foils, foils of other materials, e.g. metal, can also be used.

It is also possible to provide only a single channel in each of the inlet paths 8 if, instead of groups of objects, only individual objects are being packaged. Generally, however, a plurality of channels will be provided even substantially more than three, for example 10 or 12 channels.

The advantages of the simple structure, operating dependability and easy supervision of the above-described packaging machine are very great, particularly when a plurality of machines are arranged in a row which can then be monitored by a single operator.

It will be understood that the above description of the present invention is susceptible to various modifications, changes and adaptations, and the same are intended to be comprehended within the meaning and range of equivalents of the appended claims.

What is claimed is:

1. In a twin packaging machine composed of two packaging units, each including a folding device, an inlet path for feeding objects to be packaged to said device, means storing a sheet of packaging material, means for cutting successive packaging foils from the sheet, and a substantially horizontally extending outlet path for the finished packages, the central longitudinal axes of the inlet and outlet paths lying at least approximately in a common vertical plane, the improvement wherein the sheets of packaging material of said two units are arranged in juxtaposition between the outlet paths of said units in a plane other than said vertical planes and are disposed to enter into said devices from above said outlet path and from the side opposite that at which the objects to be packaged enter said devices, said machine comprises a support, said inlet and outlet paths and said sheets of packaging material of said two units are symmetrically arranged relative to the longitudinal axis of said support, each said folding device includes a folding plunger in said common vertical plane onto which successive objects to be packaged are placed and means for laterally displacing each associated packaging foil in order to center it above each of said plungers, said laterally displacing means of said two folding devices effect lateral displacement of their associated foils in respective diametrically opposite directions, and said inlet and outlet paths of each said unit extend in respectively diametrically opposite directions from their associated folding device.

2. An arrangement as defined in claim 1 wherein said means storing a sheet of packaging material of both said units comprise a common supply roll of packaging material disposed between said outlet paths of said two units, and means for cutting packaging material pulled from said roll into two sheets each of which constitutes the sheet of a respective unit.

3. An arrangement as defined in claims 1 or 2 wherein said support is provided with two arms disposed symmetrically to the longitudinal axis of said support and each supporting a respective folding device, and said support is further provided at its longitudinal ends with means for supporting said inlet paths and said sheets of packaging material, and wherein said folding devices are disposed at a lower level than said means storing a sheet of packaging material and than the starting ends of said inlet paths.

4. An arrangement as defined in claim 3 wherein said support is provided with a recess in its top surface and said devices are located in said recess.

5. An arrangement as defined in claim 1 wherein each said inlet path is provided with a plurality of parallel channels for conveying a plurality of objects in parallel to its associated folding device, and each said folding device further includes means defining a plurality of converging channels aligned with said inlet path channels for bringing a plurality of objects together on said plunger for forming a single package of such plurality of objects.

* * * * *